US006763545B2

(12) United States Patent
Silvers et al.

(10) Patent No.: US 6,763,545 B2
(45) Date of Patent: Jul. 20, 2004

(54) ADJUSTABLE DRIVE TRAIN AND COMPONENT CLEANER BRUSH

(75) Inventors: Eric Silvers, HCR 34G Box 14, Williams, AZ (US) 86046; Peter Muller, Los Gatos, CA (US)

(73) Assignee: Eric Silvers, Montpelier, VT (US)

( * ) Notice: Subject to any disclaimer, the term of this patent is extended or adjusted under 35 U.S.C. 154(b) by 280 days.

(21) Appl. No.: 10/045,968

(22) Filed: Oct. 24, 2001

(65) Prior Publication Data

US 2003/0075202 A1 Apr. 24, 2003

(51) Int. Cl.[7] ..... A46B 7/00; A47L 13/12
(52) U.S. Cl. ..... 15/106; 15/160; 15/172
(58) Field of Search ..... 15/106, 114, 118, 15/172, 160

(56) References Cited

U.S. PATENT DOCUMENTS

| | | | | |
|---|---|---|---|---|
| 575,520 | A | | 1/1897 | Grupelli et al. |
| 628,087 | A | | 7/1899 | Gibford |
| 635,778 | A | | 10/1899 | Hudelson |
| 2,528,992 | A | * | 11/1950 | Barr |
| 4,578,120 | A | | 3/1986 | Chiarella |
| 4,593,923 | A | | 6/1986 | Thalmann |
| 4,858,266 | A | | 8/1989 | Engstrom |
| 5,070,569 | A | | 12/1991 | Wilkins |
| 5,072,481 | A | * | 12/1991 | Weyer |
| 6,108,852 | A | * | 8/2000 | Vrignaud |

FOREIGN PATENT DOCUMENTS

| | | | |
|---|---|---|---|
| AT | 123544 | * | 6/1931 |
| FR | 1227009 | * | 2/1960 |
| GB | 1578927 | * | 11/1980 |

* cited by examiner

*Primary Examiner*—Randall Chin

(57) ABSTRACT

An adjustable brush for cleaning a drive or sprocket chain has a C-shaped toolhead fixed to a handle with an opposing cleaning element. The length of the handle sufficiently keeps users hands away from the chain during cleaning, and provides a means for the opposing cleaning element to clean generally inaccessible areas. The toolhead defines a chain passage recess having a plurality of inner sides. Each inner side has projecting retaining members to define a brush block cavity adapted to removably receive a brush block element such that a cleaning member formed thereon projects into the recess. Likewise, the opposing cleaning element has a pair of retaining members projecting therefrom to define a brush block cavity adapted to removably receive a brush block element. Grooves formed in sides of the brush block elements are interengageable with ridges depending from the retaining members, thereby permitting the brush block element's position to be adjusted, such that the cleaning members associated with the respective inner sides of the toolhead are thereby brought closer together to adjust the dimensions of the recess in order to conform to the size of the drive or sprocket chain.

17 Claims, 4 Drawing Sheets

ADJUSTABLE DRIVE TRAIN AND COMPONENT CLEANER BRUSH

BACKGROUND OF THE INVENTION

1. Technical Field

The invention relates to drive chain and component cleaning and maintenance. More specifically, the invention relates to an adjustable cleaner brush for simultaneously cleaning at least three sides of a sprocket or drive chain, and for cleaning components on bicycles, motorcycles or similar vehicles that are generally inaccessible.

2. Description of the Prior Art

The drive or sprocket chains used to transfer power from a motorcycle engine to the drive wheel are generally at least partially open to the surrounding environment. As a result, the chain accumulates dirt and hard grit which settle upon the chain itself, as well as in the lubrication oil with which the chain is coated. Such grit and dirt serves as a wear or grinding medium acting upon the chain during use, thereby reducing chain performance and durability.

A motorcycle drive chain is ideally relubricated after, or before, every significant use to avoid undesirable wearing. Prior to lubrication, the chain is thoroughly cleaned to remove dirt, grit, grime, and grunge, which have adhered to the chain and lubricant. If such accumulated contaminants are not removed, relubrication merely mixed the dirt and grit particles with new lubricant. The resulting grinding mixture may result in detrimental wear and cause chain failure. Such wearing of the chain also decreases the precision of its meshing with the drive mechanism so that a less precise drive is obtained.

In the prior art, an ordinary tooth brush or wire brush is typically used to clean the chain. The tooth brush or wire brush is vigorously applied in sequence to all sides of the chain. This process removes not only the accumulated dirt and grit, but also the principal portion of the prior lubrication. The chain may then be relubricated with a fresh lubricant such as oil or grease. Alternately, the chain may be passed through a solvent solution to dissolve additional old lubricant from the chain prior to relubricating.

The chain may also be dipped or otherwise cleaned initially with solvent and then brushed. However, this procedure is both messy and expensive, as large quantities of solvent are contaminated with the contaminated lubricant. In addition, the solvent may attract and dissipate lubricating grease incorporated inside the drive chain rollers by the chain manufacturer. This is especially prevalent for sprocket chains that have rubber sealing rings at the chain roller ends to ensure retention of lubricant in the rollers. In such cases, the solvent may not only remove the encapsulated lubricant, but may also promote deterioration of the rubber or polymer sealing rings.

Despite these disadvantages, there is a tendency among maintenance workers to use only solvent prior to relubrication, to save time. This results in damage to the chains. Manually brushing away accumulated contaminants from the chain surface using the prior art tooth brush or wire brush methods is time-consuming, tedious, and not completely effective. In fact, such manual brushing considerably adds to the expense of operation and maintenance of a motorcycle, bicycle, or similar vehicle.

Various devices for cleaning bicycle chains have been proposed in the prior art. Three examples of such cleaning devices are disclosed in Grupelli, Bicycle Chain Cleaner, U.S. Pat. No. 575,520 (Jan. 19, 1897), Hudelson, Brush for Bicycle Chains, U.S. Pat. No. 625,778 (Oct. 31, 1899), Gibford, Cleaner for Bicycle Chains, U.S. Pat. No. 628,087 (Jul. 4, 1899). In all three devices, brush type cleaners are mounted directly to a bicycle such that the bicycle chain passes over the brush cleaners during bicycle operation. The devices are complicated to produce, adjust, and use and do not thoroughly clean the chain. Furthermore, such devices may not be adaptable to the increased friction generated by the higher velocities of motorcycles.

Mechanical cleaning means have also been proposed for cleaning chains. Examples of such devices are disclosed in Chiarella, Bicycle Chain Cleaning Device and Method, U.S. Pat. No. 4,578,120 (Mar. 25, 1986) and Thalmann, Bicycle sprocket Chain Cleaner, U.S. Pat. No. 4,593,923. Each of these devices provides a reservoir for containing a quantity of solvent or lubricant. The devices may be placed around the chain while it remains on the bicycle. Rotatable sprocket brushes having spaced-apart bristle tufts on their periphery are mounted within a cover. Movement of the chain through the device causes the chain to dip into the solvent or lubricant.

While the Chiarella and Thalmann devices are useful in extending the life of a bicycle chain, they are too small to be used with a motorcycle chain. Furthermore, the higher speeds of the motorcycle chain passing through the devices may result in inadequate contact with, or excessive consumption of, the solvent or lubricant. In addition, it is unsafe to use such devices while operating a motorcycle at high speeds. Contaminants are mixed back into the reservoir, resulting in undesirable contamination of the solvent or lubricant. Additionally, Chiarella and Thalmann do not thoroughly clean the chain. The brushes themselves are subject to extreme wear. However, neither Chiarella nor Thalmann permits the brushes to be replaced when no longer functioning. The entire device must therefore be replaced, thereby increasing the costs to the user.

Engstrom proposed a bicycle cleaning tool, Bicycle Tool, U.S. Pat. No. 4,858,266 (Aug. 22, 1989). This hand-held device is used in a similar manner as the toothbrush. Only one brush element is provided.

In Wilkins, Brush Cleaner for Sprocket Chains, U.S. Pat. No. 5,070,569 (Dec. 10, 1991), an adjustable motorcycle cleaning brush has been disclosed. This device is adjusted in the maker of a pipe wrench, by manually rotating a roller to move one wall of the cleaning channel. It is difficult and costly to fabricate such device. The wire bristles used with this prior art brush cleaner may damage sprocket chains using polymer sealing rings. Furthermore, it is only possible to adjust one dimension of the cleaning channel. Thus, the brush cannot be adjusted to securely fit and clean chains having different widths as well as heights.

It would therefore be advantageous to provide a cleaner brush that can effectively clean dirt and grit from a drive or sprocket chain, without causing further contamination to the lubricating solution. It would be a further advantage if such cleaner brush were adjustable to accommodate different sized chains. It would be yet another advantage if the cleaner brushes were readily replaced when worn, or if a different type of cleaner were desired.

SUMMARY OF THE INVENTION

The invention provides an adjustable brush for cleaning drive or sprocket chains, and components on motorcycles, bicycles, or similar vehicles. A C-shaped toolhead retaining three brush block elements is fixed to a handle with a fixed opposing cleaning element retaining one brush block. The toolhead end of the handle is generally used to clean the chain. The opposing cleaning element end of the handle is generally used to clean other areas that are generally inaccessible.

The handle's length keeps users' hands away from the chain during chain cleaning, and provides a means for the opposing cleaning element to clean generally inaccessible areas. The chain passage recess defined by the toolhead has at least two opposing inner sides, with a non-opposing inner side in-between. Each inner side has parallel first and second retaining members projecting therefrom and into the recess. The retaining members have parallel and opposing first and second ridges depending therefrom, to define a brush block cavity. Likewise, the opposing cleaning element has parallel first and second retaining members projecting from the handle with parallel and opposing first and second ridges depending therefrom, to define a brush block cavity.

A brush block element, having a base with a cleaning member formed on the side thereof, is dimensioned for removable insertion with each brush block cavity. The brush block element preferably has at least two parallel grooves adapted to receive the parallel ridges depending from the retaining members projecting from inside the toolhead of the handle. In a first position, the brush block element is entirely retained within the brush block cavity. In a second position, the grooves on the sides of the brush block elements are engaged with the ridges of the retaining members such that a part of the brush block projects from the brush block cavity and into the chain passage recess. The bristles of the brush block elements associated with the respective inner sides of the toolhead are thereby brought closer together. The dimensions of the chain passage recess are thus adjusted to conform to the size of the drive or sprocket chain to be cleaned.

Brush block elements may be provided with different bristle sizes and configurations, according to the particular requirements of the user. In the preferred embodiment of the invention, the cleaning member of the brush block elements in the toolhead is a plurality of short, stiff, nylon or polypropylene bristles. The cleaning member of the brush block element in the opposing cleaning element, is a plurality of long, stiff, nylon or polypropylene bristles.

DETAILED DESCRIPTION OF THE INVENTION

The invention provides an adjustable brush for cleaning a drive or sprocket chain. The invention permits the cleaning of such chain without requiring its removal from the vehicle. The invention further provides a convenient means to clean components on bicycles, motorcycle, and similar vehicles that are generally inaccessible.

Figure 1:
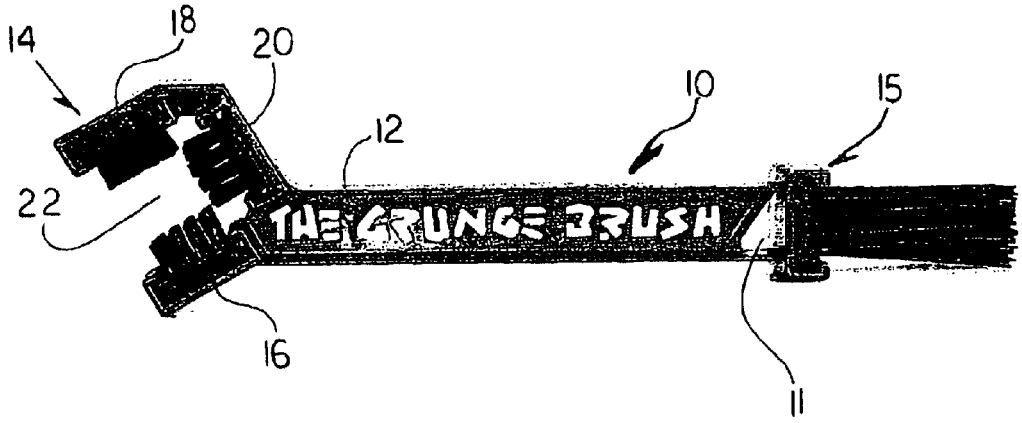
FIG. 1 is a side view of the cleaner brush, according to the invention.

FIG. 1 is a side view of the cleaner brush 10 according to the invention. A C-shaped toolhead 14 is fixed to a handle 12 whose length keeps the users' hands away from the chain during cleaning, and allows for the opposing cleaning element 15 to clean generally inaccessible areas on bicycles, motorcycles, and similar vehicles. While in the preferred embodiment of the invention, the handle is joined at an angle to the toolhead, this placement may be varied according to the desired use for the brush. A hole 11 may be formed through the handle to permit the cleaner brush to be suspended from a hook. This hole may be molded as a part of the handle, or drilled through the handle after fabrication.

Figure 2:
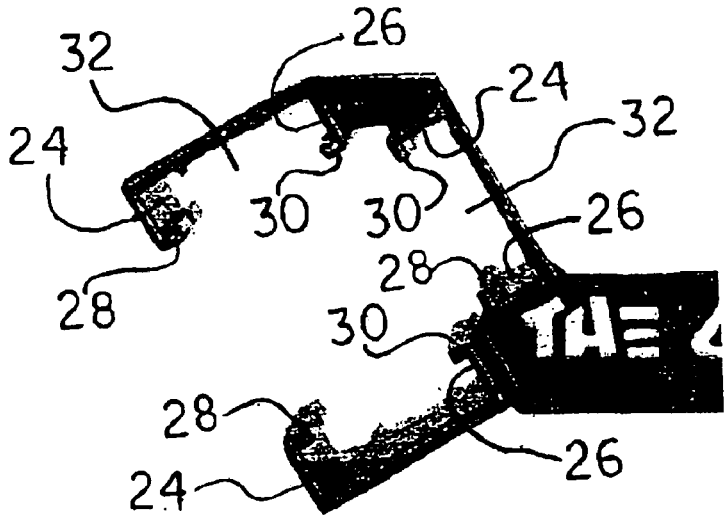
FIG. 2 is a side sectional view of the toolhead section of the cleaner brush, according to the invention.
Figure 3:
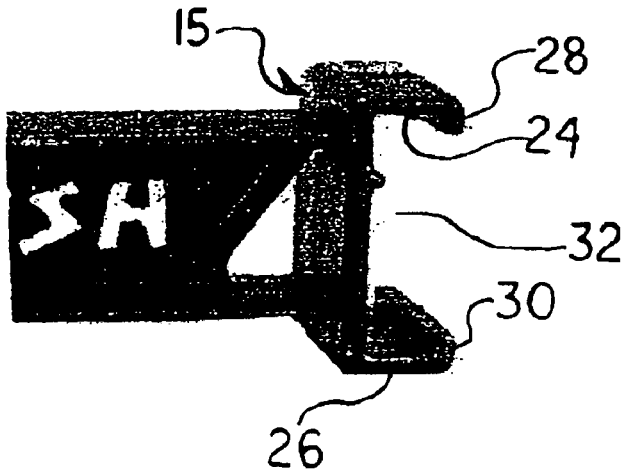
FIG. 3 is a side sectional view of the opposing cleaning element section of the cleaner brush, according to the invention.

The C-shaped toolhead has at least two opposing inner sides 16, 18 with a non-opposing inner side 20 in-between. These inner sides define a chain passage recess 22 within the toolhead. FIG. 2 is a side sectional view showing the adjustable cleaner brush according to the invention. Each inner side has parallel first and second retaining members 24, 26 projecting therefrom and into the recess. The retaining members have parallel and opposing first and second ridges 28, 30 depending therefrom, to define a brush block cavity 32. FIG. 3 is a side sectional view showing the adjustable cleaner brush according to the invention. The opposing cleaning element 15 has parallel first and second retaining members 24, 26 projecting therefrom. The retaining members have parallel and opposing first and second ridges 28, 30 depending therefrom to define a brush block cavity 32.

In alternate embodiments of the invention, the toolhead may have any appropriate number of adjacent sides. These sides may be parallel or nonparallel, as desired. Additionally, each inner side is not limited to defining one brush block cavity. In one embodiment of the invention one or more of the inner sides defines a plurality of brush block cavities.

The handle is fabricated by any suitable method, including molding. The toolhead may be formed as an integral part of the handle. In other embodiments of the invention, however, the toolhead is formed separately and joined to the handle by means such as snaps, adhesive or screws. The toolhead may thus be replaced if worn out, defective, or if a different size toolhead is required. The handle and toolhead are preferably formed of plastic, but may also be formed of materials including metal, wood, or ceramic.

Figure 4A:
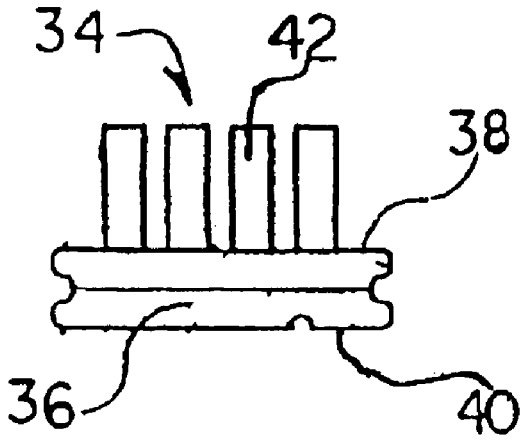
FIG. 4*a* is a front view of the brush block element, according to the invention.

A brush block element is provided for removable insertion within each brush block cavity. FIG. 4*a* is a front view of the brush block element 34 according to the invention. Each brush block element has a substantially rectangular base 36 having an upper side 38 and a lower side 40. A cleaning member 42 is formed by tufting nylon, polypropylene, brass, copper, steel or any other suitable material according to cleaning task at hand, into holes on the upper side 38 of base 36.

Figure 4B:
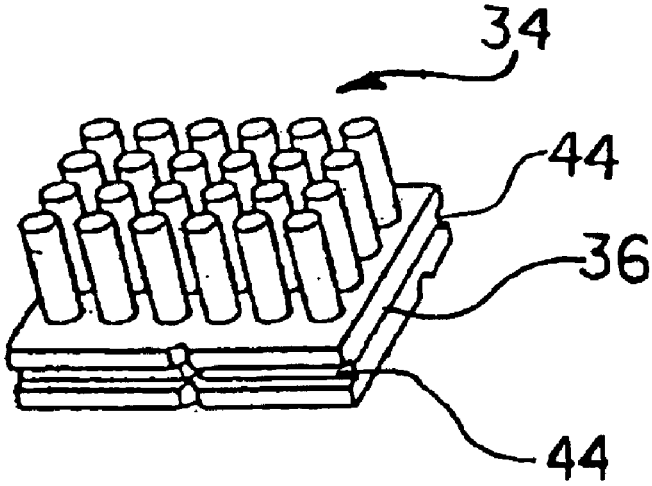
FIG. 4*b* is a side view of the brush block element, according to the invention.

FIG. 4*b* is a side view of the brush block element according to the invention. In the preferred embodiment of the invention, the brush block element 34 has at least two parallel grooves 44 formed on at least two of the parallel edge sides of the base 36. The parallel grooves are adapted to interengage with the parallel and opposing first and second ridges 28, 30 depending from the first and second retaining members 24, 26.

Figure 5A:
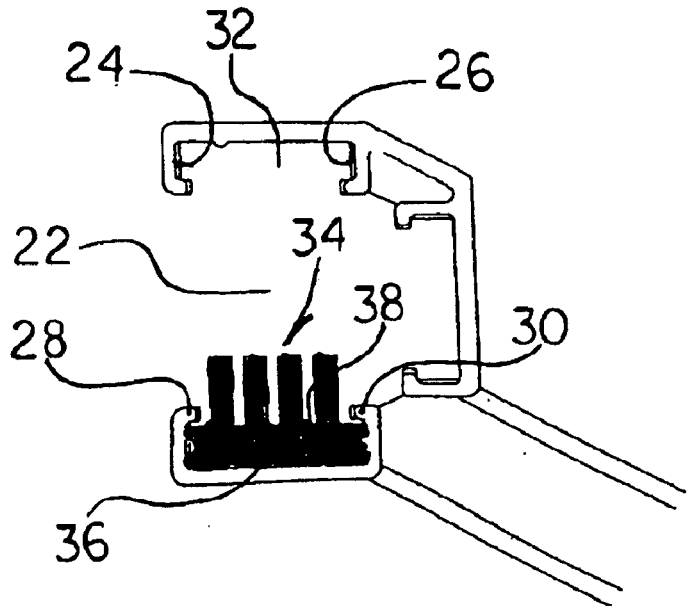
FIG. 5*a* is a side sectional view of the toolhead section of the cleaner brush with the brush block element inserted into the first position, according to the invention.
Figure 5B:
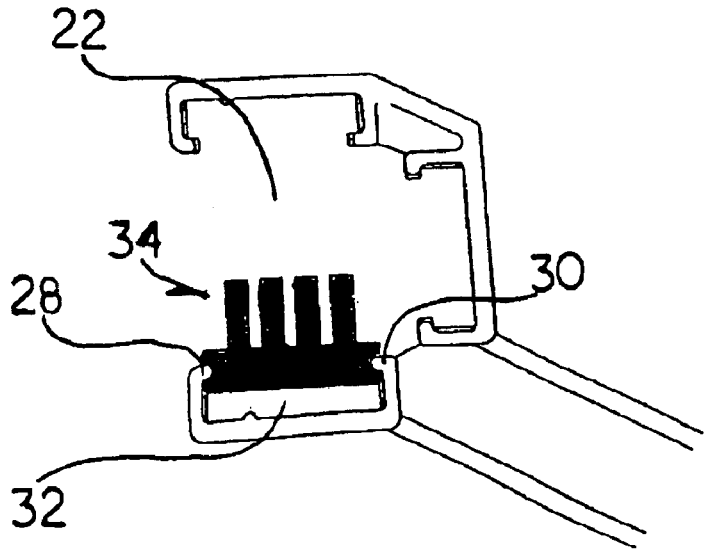
FIG. 5*b* is a side sectional view of the toolhead section of the cleaner brush with the brush block element inserted into the second position, according to the invention.

FIG. 5*a* and FIG. 5*b* are side sectional views showing the adjustable cleaner brush according to the invention. The brush block element 34 is inserted into the brush block cavity 32, with the lower side inside the brush block cavity and the cleaning member projecting into the chain passage recess 22. In a first position, FIG. 5*a*, the base 36 is entirely retained within the brush block cavity 32. In this position, the first and second ridges 28, 30 contact the upper side 38 of the base, thereby securing the element. In a second position, FIG. 5*b*, the grooves 44 of the base 36 are engaged with the complimentary parallel and opposing first and second ridges 28, 30 depending from first and second retaining members 24, 26, such that a part of the base projects from the brush block cavity and into the chain passage recess 22.

The cleaning member 42 projects further into the chain passage recess in the second position than in the first. The cleaning member may thereby be brought into contact with smaller sized chains. In alternate embodiments of the invention, the base has a plurality of parallel grooves. The brush block element may thereby be adjusted to proportion the chain passage recess to clean various sizes of chains.

The brush block element may be removed from the brush block cavity when desired by sliding or snapping it out from the retaining members. Brush block elements having different types and sizes of cleaning members may thereby be readily interchanged. In the preferred embodiment of the invention, the cleaning member is a plurality of nylon bristles 48. In an alternate, equally preferred embodiment, the bristles are formed of metal, such as brass, copper, or steel. In alternate embodiments of the invention, the cleaning member includes sponges, meshes, bristles formed of other materials, and abrasive materials (ie. sandpaper). Brush block elements may be provided with different cleaning member or bristle sizes and configurations, according to the particular requirements of the user.

Although the invention is described herein with reference to the preferred embodiment, one skilled in the art will readily appreciate that other applications may be substituted for those set forth herein without departing from the spirit and scope of the present invention. For example, lubricant may be applied to the chain using a separate set of brush block elements from the cleaner brush block elements. Accordingly, the invention should only be limited by the claims included below.

What is claimed is:

1. An adjustable cleaner brush, comprising:

a handle;

a toolhead attached to said handle, said toolhead formed into a C-shaped configuration having at least two opposing inner sides with a nonopposing innerside therebetween, and defining a chain passage recess therewithin, each of said inner sides defining at least one brush block cavity adapted to removably receive a brush block element;

adjustment means for moving said brush block elements to vary the dimensions of said chain passage recess; and an opposing cleaning element attached to the end of said handle opposing said toolhead defining at least one brush block cavity adapted to removably receive a brush block element.

2. The adjustable cleaner brush of claim 1, wherein said brush block element further comprises:

a substantially rectangular base having an upper side, a lower side, and two pairs of substantially parallel edge sides, said base dimensioned for removable insertion into said brush block cavity; and a cleaning member attached to said upper side of said base such that said cleaning member projects into said recess.

3. The adjustable cleaner brush of claim 2, wherein said opposing inner sides of said toolhead further comprise:

at least a first retaining member having a first ridge depending therefrom; and a parallel, second retaining member having a second ridge depending therefrom, parallel and opposed to said first ridge, to define said brush block cavity.

4. The adjustable cleaner brush of claim 3, wherein at least one groove is defined by each side of one of said pairs of parallel edge sides of said base, said grooves being substantially parallel to one another and adapted to receive said first and second ridges, such that, in a first position, said first and second ridges retain said base entirely within said brush block cavity, and, in a second position, said first and second ridges are received by said parallel grooves to retain said base with a part of said base projecting into said recess, thereby varying the dimensions of said chain passage recess.

5. The adjustable cleaner brush of claim 3, wherein at least first and second substantially parallel grooves are defined by said upper side of said base, such that said first groove is adapted for complementary interengagement with said first ridge of one of said retaining members, and said second groove is adapted for complementary interengagement with said second ridge of the other of said retaining members.

6. The adjustable cleaner brush of claim 2, wherein said cleaning member is a plurality of bristles.

7. The adjustable cleaner brush of claim 6, wherein said bristles are formed of nylon.

8. The adjustable cleaner brush of claim 6, wherein said bristles are formed of metal.

9. The adjustable cleaner brush of claim 2, wherein said cleaning member is selected from the group consisting of sponges, meshes, and abrasive materials.

10. The adjustable cleaner brush of claim 1, wherein said brush block element is formed of a material that is resistant to oils, solvents, lubricants and cleansing detergents.

11. The adjustable cleaner brush of claim 1, wherein said handle defines a hole therethrough.

12. An adjustable cleaner brush, comprising:

a handle;

a toolhead attached to said handle formed into a C-shaped configuration defining a chain passage recess and having at least two opposing inner sides with a non-opposing inner side therebetween;

an opposing cleaning element attached to the end of said handle opposing said toolhead;

at least a first retaining member with a first ridge depending therefrom and at least a parallel, second retaining member having a second ridge depending therefrom and opposed to said first ridge projecting from each inner side of said toolhead and said opposing cleaning element to define a brush block cavity;

a substantially rectangular base having an upper side, a lower side, and two pairs of substantially parallel edge sides, said base dimensioned for removable insertion into said brush cavity;

a cleaning member attached to said upper side of said base such that said cleaning member projects into said recess, wherein at least one groove is defined by each side of one of said pairs of parallel edge sides, said grooves being substantially parallel to one another and adapted to receive said first and second ridges, such that, in a first position, said first and second ridges retain said base entirely within said brush block cavity and, in a second position, said first and second ridges are received by said parallel grooves to retain said base with a part of said base projecting into said recess, thereby varying the dimensions of said chain passage recess.

13. The adjustable cleaner brush of claim 12, wherein said cleaning member is a plurality of bristles.

14. The adjustable cleaner brush of claim 13, wherein said bristles are formed of nylon.

15. The adjustable cleaner brush of claim 13, wherein said bristles are formed of metal.

16. The adjustable cleaner brush of claim 12, wherein said cleaning member is selected from the group consisting of sponges, meshes, and abrasive materials.

17. The adjustable cleaner brush of claim 12, wherein said brush block element is formed of a material that is resistant to oils, solvents, lubricants and cleansing detergents.

* * * * *